US011819074B2

(12) United States Patent
Takahashi et al.

(10) Patent No.: US 11,819,074 B2
(45) Date of Patent: Nov. 21, 2023

(54) AIR-CONDITIONING GARMENT

(71) Applicants: Tetsuya Takahashi, Toyota (JP); Atsumi Tsuzuki, Okazaki (JP); Tsutomu Numazawa, Fukaya (JP); Takanori Hayashi, Ageo (JP)

(72) Inventors: Tetsuya Takahashi, Toyota (JP); Atsumi Tsuzuki, Okazaki (JP); Tsutomu Numazawa, Fukaya (JP); Takanori Hayashi, Ageo (JP)

(73) Assignees: TOYOTA JIDOSHA KABUSHIKI KAISHA, Toyota (JP); ROYAL ELECTRIC CO., LTD., Tokyo (JP)

( * ) Notice: Subject to any disclaimer, the term of this patent is extended or adjusted under 35 U.S.C. 154(b) by 51 days.

(21) Appl. No.: 17/520,970

(22) Filed: Nov. 8, 2021

(65) Prior Publication Data

US 2022/0142278 A1 May 12, 2022

(30) Foreign Application Priority Data

Nov. 10, 2020 (JP) ..... 2020-186916

(51) Int. Cl.

| | |
|---|---|
| ***A41D 27/28*** | (2006.01) |
| ***A41D 13/002*** | (2006.01) |
| ***A41D 1/00*** | (2018.01) |
| *A01D 1/00* | (2006.01) |

(52) U.S. Cl.

CPC ..... *A41D 27/28* (2013.01); *A41D 1/002* (2013.01); *A41D 13/0025* (2013.01); *F24F 2221/38* (2013.01)

(58) Field of Classification Search

CPC ..... A41D 13/002; A41D 13/0025; A61F 2007/0233; A61F 2007/0234; A61F 2007/0238

See application file for complete search history.

(56) References Cited

U.S. PATENT DOCUMENTS

| | | | | |
|---|---|---|---|---|
| 10,426,204 | B2 * | 10/2019 | Squires | A41D 13/0025 |
| 10,731,665 | B2 * | 8/2020 | Ichigaya | F04D 29/601 |
| 10,760,591 | B2 * | 9/2020 | Ichigaya | A47C 7/744 |
| 11,051,563 | B2 * | 7/2021 | Kittaka | F04D 29/601 |
| 11,219,251 | B2 * | 1/2022 | Ichigaya | A41D 13/0025 |
| 2005/0000231 | A1 * | 1/2005 | Lee | F25B 21/04 62/3.5 |

(Continued)

FOREIGN PATENT DOCUMENTS

| | | |
|---|---|---|
| JP | 2018-513932 A | 5/2018 |
| JP | 2020-020056 A | 2/2020 |

(Continued)

*Primary Examiner* — Alissa L Hoey
(74) *Attorney, Agent, or Firm* — Sughrue Mion, PLLC

(57) ABSTRACT

An air-conditioning garment includes a garment main part that is worn on the upper body of a wearer, and two fans that are attached to a lower part of a back part of a garment main part, and configured to feed outside air into the inside of the garment main part. Each of the two fans includes a fan main body and a case that houses the fan main body and includes two air outlets. The two air outlets are formed so that their blowing directions are restricted to being upward or obliquely upward. The two air outlets are formed in such a manner that their blowing directions have an upwardly-opened V-shape.

3 Claims, 6 Drawing Sheets

(56) References Cited

U.S. PATENT DOCUMENTS

| | | | | |
|---|---|---|---|---|
| 2006/0080987 | A1* | 4/2006 | Ichigaya | A41D 13/0025 62/304 |
| 2007/0050878 | A1* | 3/2007 | Ichigaya | A41D 13/0025 2/69 |
| 2013/0121816 | A1* | 5/2013 | Tang | F04D 29/4246 415/203 |
| 2016/0270457 | A1* | 9/2016 | Chen | A41D 13/0025 |
| 2018/0180345 | A1* | 6/2018 | Zhu | F04D 27/003 |
| 2018/0209432 | A1 | 7/2018 | Lee | |
| 2019/0166928 | A1* | 6/2019 | Miwa | A62B 18/006 |
| 2019/0239578 | A1* | 8/2019 | Ichigaya | A41D 13/005 |
| 2020/0359715 | A1* | 11/2020 | Tokunaga | A41D 27/28 |
| 2021/0120890 | A1* | 4/2021 | Tokunaga | A41D 13/005 |
| 2021/0195973 | A1* | 7/2021 | Ichigaya | A41D 27/10 |
| 2021/0204622 | A1* | 7/2021 | Ichigaya | A41D 1/02 |
| 2021/0355963 | A1* | 11/2021 | Kang | F04D 29/281 |
| 2021/0386129 | A1* | 12/2021 | Ichigaya | A41D 27/28 |
| 2021/0392962 | A1* | 12/2021 | Matsui | F04D 25/12 |
| 2022/0218060 | A1* | 7/2022 | Yamauchi | A41D 27/28 |
| 2022/0295917 | A1* | 9/2022 | Ichigaya | F04D 25/084 |
| 2022/0312862 | A1* | 10/2022 | Kano | A41D 31/12 |
| 2022/0386712 | A1* | 12/2022 | Ichigaya | A41D 1/002 |
| 2022/0408856 | A1* | 12/2022 | Katsuta | A41D 27/28 |

FOREIGN PATENT DOCUMENTS

| | | | |
|---|---|---|---|
| JP | 2020-133493 | A | 8/2020 |
| WO | 2020/170477 | A1 | 8/2020 |

* cited by examiner

AIR-CONDITIONING GARMENT

CROSS REFERENCE TO RELATED APPLICATIONS

This application is based upon and claims the benefit of priority from Japanese patent application No. 2020-186916, filed on Nov. 10, 2020, the disclosure of which is incorporated herein in its entirety by reference.

BACKGROUND

The present disclosure relates to air-conditioning garment.

As a measure for preventing heat strokes, an air-conditioning garment that prevents or reduces a rise in body temperature of a worker working under a high-temperature environment has been known. For example, Patent Literature 1 (Japanese Unexamined Patent Application Publication No. 2020-20056) discloses an air-conditioning garment that cools a body by taking outside air into the inside of a garment main part. This air-conditioning garment is composed of a long-sleeved garment main part that covers the upper body of a user, and two fans attached at or near a waist part of the garment main part. Each of the fans is an axial-flow fan in which rotating blades are covered by a porous case.

SUMMARY

It should be noted that a certain wind velocity is required to evaporate sweat. However, in the configuration disclosed in the aforementioned Patent Literature 1, its attention is paid only to taking in outside air into the inside of the garment main part, so that there is room for making it possible to obtain such a required wind velocity more securely by paying attention to this matter.

An object of the present disclosure is to provide a technique for securing a sufficient wind velocity inside a garment main part.

A first exemplary aspect is an air-conditioning garment including: a garment main part adapted to be worn on an upper body of a wearer; and at least one fan attached to a lower part of a back part of the garment main part, the at least one fan being configured to feed outside air into inside of the garment main part, in which the at least one fan includes a fan main body, and a case including at least one air outlet, the case being configured to house the fan main body, and the at least one air outlet is formed so that a blowing direction is restricted to being upward or obliquely upward. According to the above-described configuration, it is possible to secure a sufficient wind velocity up to the shoulders of the wearer.

The at least one air outlet may include two air outlets, and the two air outlets may be formed in such a manner that their blowing directions have an upwardly-opened V-shape. According to the above-described configuration, it is possible to secure a sufficient wind velocity over a wide range in the shoulder-width direction.

The at least one fan may be a centrifugal fan; the case may include a circumferential wall that is opposed to the fan main body in a radial direction; a part of the circumferential wall that is located below a rotation axis of the fan main body may extend in an arc shape centered at the rotation axis; a part of the circumferential wall that is located above the rotation axis of the fan main body may have a shape formed in such a manner that the closer it becomes to a top part of the case, the more it is separated from the rotation axis; the two air outlets may be a first air outlet and a second air outlet, respectively; the first air outlet may be formed, in a first circumferential wall part of the circumferential wall located on one side of a vertical plane including the rotation axis, at a position opposed to the rotation axis in the shoulder-width direction; the second air outlet may be formed, in a second circumferential wall part of the circumferential wall located on the other side of the vertical plane including the rotation axis, at a position located above the rotation axis; and the fan main body may be configured to rotate so that a blade of the fan main body is successively opposed to the first air outlet, the part of the first circumferential wall part located above the rotation axis, and the second air outlet in this order. According to the above-described configuration, it is possible to realize blowing directions having an upwardly-opened V-shape.

The at least one fan may include two fans, and the two fans may be arranged side by side in the shoulder-width direction. According to the above-described configuration, it is possible to secure a sufficient wind velocity in a wider range in the shoulder-width direction. Further, since the blowing directions are restricted to being upward or obliquely upward, winds blown from the two fans do not cancel each other out.

According to the present disclosure, it is possible to secure a sufficient wind velocity up to the shoulders of a wearer.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
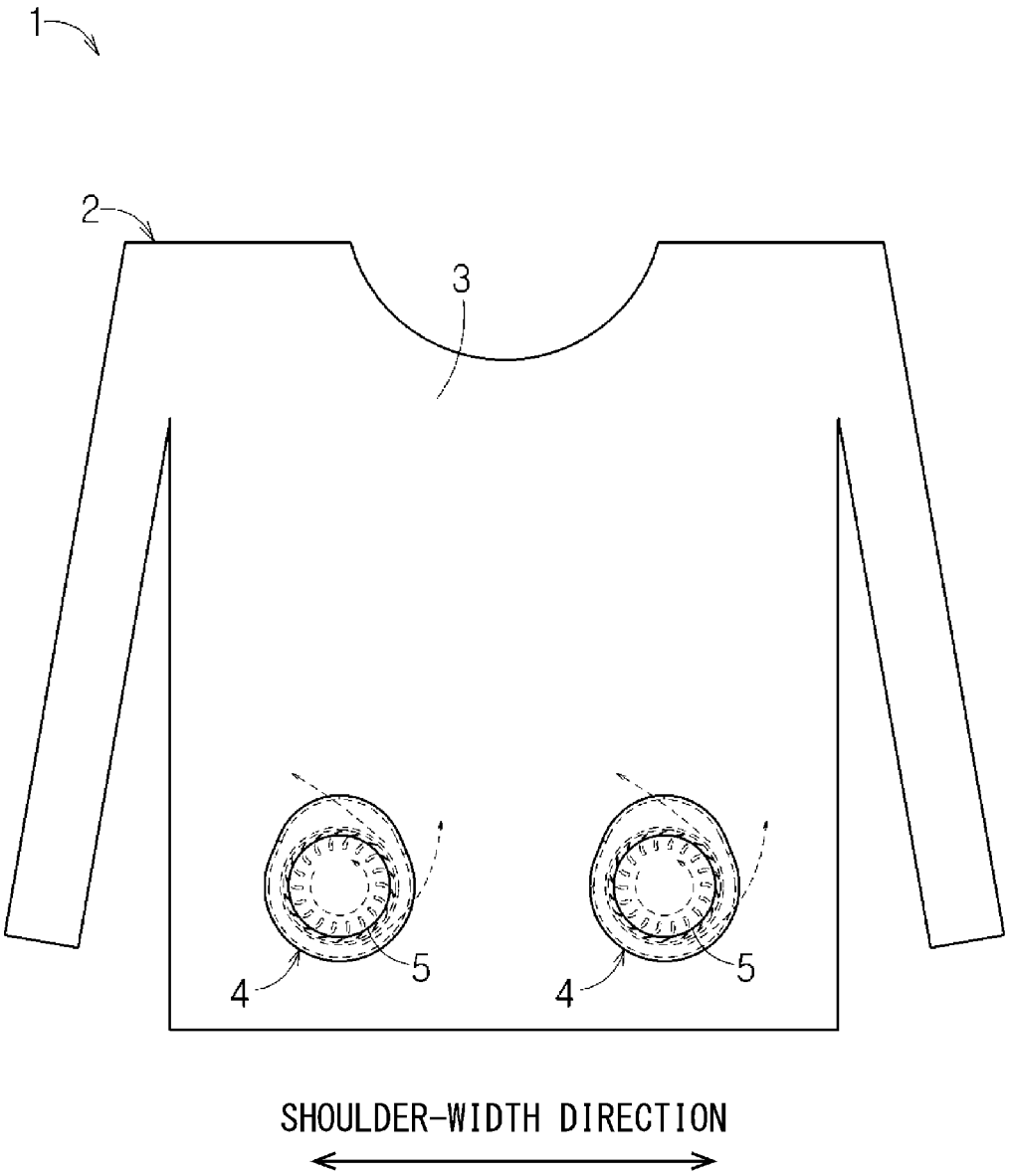
FIG. 1 is a rear view of an air-conditioning garment.

The present disclosure will be explained hereinafter through embodiments according to the present disclosure. However, the below-shown embodiments are not intended to limit the scope of the present disclosure specified in the claims. Further, all the components/structures described in the embodiments are not necessarily indispensable as means for solving the problem. For clarifying the explanation, the following description and the drawings are partially omitted and simplified as appropriate. The same reference numerals (or symbols) are assigned to the same elements throughout the drawings and redundant explanations thereof are omitted as appropriate.

FIG. 1 shows a rear view of an air-conditioning garment 1. As shown in FIG. 1, the air-conditioning garment 1 according to this embodiment includes a long-sleeved garment main part 2 that is worn on the upper body of a wearer, and two fans 4 attached to a lower part of a back part 3 of the garment main part 2, and configured to feed outside air into the inside of the garment main part 2.

In the lower part of the back part 3 of the garment main part 2, two fan-attaching holes 5 are formed at places that are away from each other in the shoulder-width direction. Specifically, the lower part of the back part 3 is a part of the back part 3 that is opposed to the waist of the wearer or its vicinity. The two fans 4 are arranged so as to respectively correspond to the two fan-attaching holes 5. Each of the fans 4 feeds outside air into the inside of the garment main part 2 through a respective one of the fan-attaching holes 5.

Note that the garment main part 2 may be a short-sleeved garment main part instead of the long-sleeved one, and may be one that covers both the upper and lower bodies at the same time.

In this embodiment, the two fans 4 have shapes identical to each other, and are attached to the garment main part 2 so as to face in the same direction as each other. Therefore, only one of the fans 4 will be described hereinafter while the description of the other fan 4 will be omitted.

Figure 2:
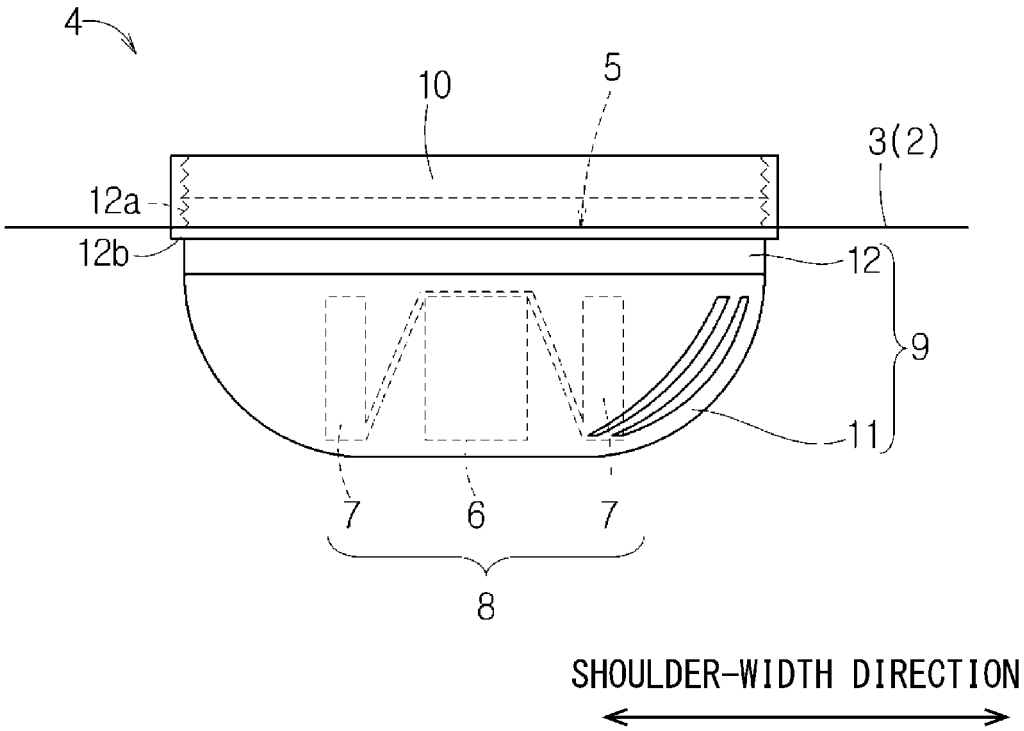
FIG. 2 is a bottom view of a fan.
Figure 3:
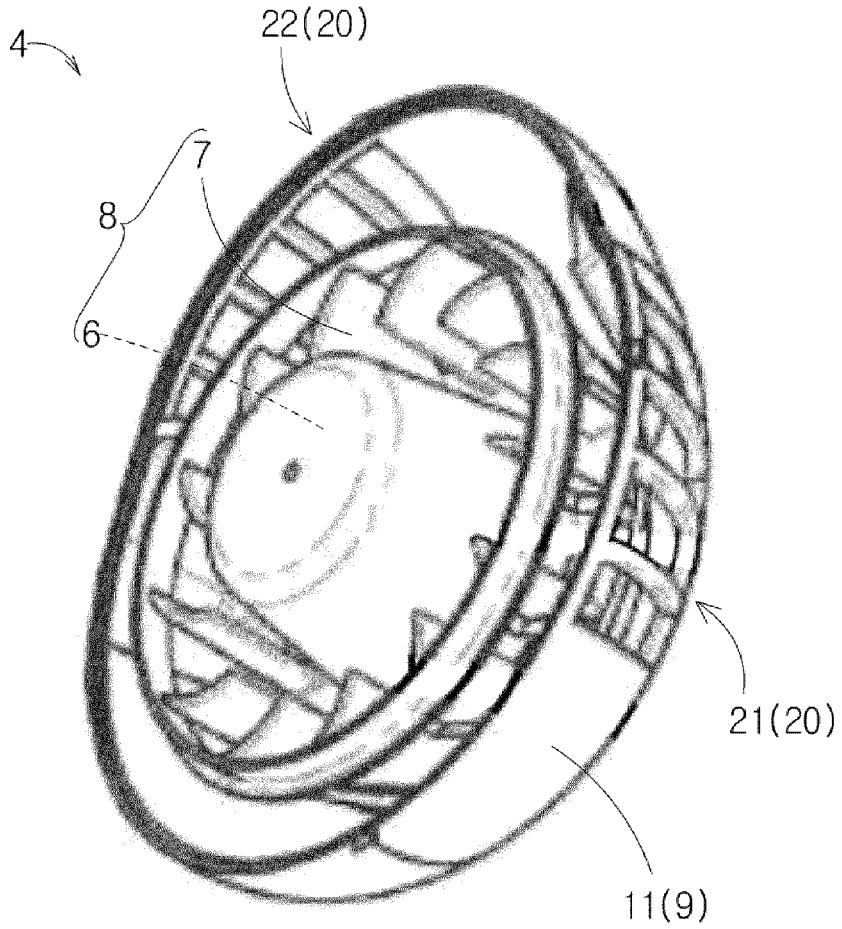
FIG. 3 is a perspective view of a fan.

FIG. 2 shows a bottom view of one of the fans 4. FIG. 3 shows a perspective view of one of the fans 4. In this embodiment, each of the fans 4 is a turbo fan, which is a specific example of a centrifugal fan. Alternatively, each of the fans 4 may be a sirocco fan, which is another specific example of a centrifugal fan, or may be an axial-flow fan. As shown in FIGS. 2 and 3, each of the fans 4 includes a fan main body 8 composed of a motor 6 and a plurality of blades 7 fixed to an output axis of the motor 6, a case 9 that houses the fan main body 8, and an attaching nut 10. In the following description in this specification, a "radial direction" is defined as a direction perpendicular to the longitudinal direction of the rotation axis of the motor 6. An "axial direction" is defined as a direction that coincides with the longitudinal direction of the rotation axis of the motor 6.

As shown in FIG. 2, the case 9 includes a main case 11 that is opposed to the fan main body 8 in the radial direction, and a sub-case 12 that can be mated with the main case 11. A male screw 12*a* and a flange 12*b* are formed on the outer circumferential surface of the sub-case 12. Further, the male screw 12*a* of the sub-case 12 is inserted into a respective one of the fan-attaching holes 5, and the attaching nut 10 is fastened onto the male screw 12*a* of the sub-case 12. As a result, the peripheral edge of the respective one of the fan-attaching holes 5 is sandwiched between the flange 12*b* of the sub-case 12 and the attaching nut 10, so that each of the fans 4 is attached to the back part 3 of the garment main part 2.

Figure 4:
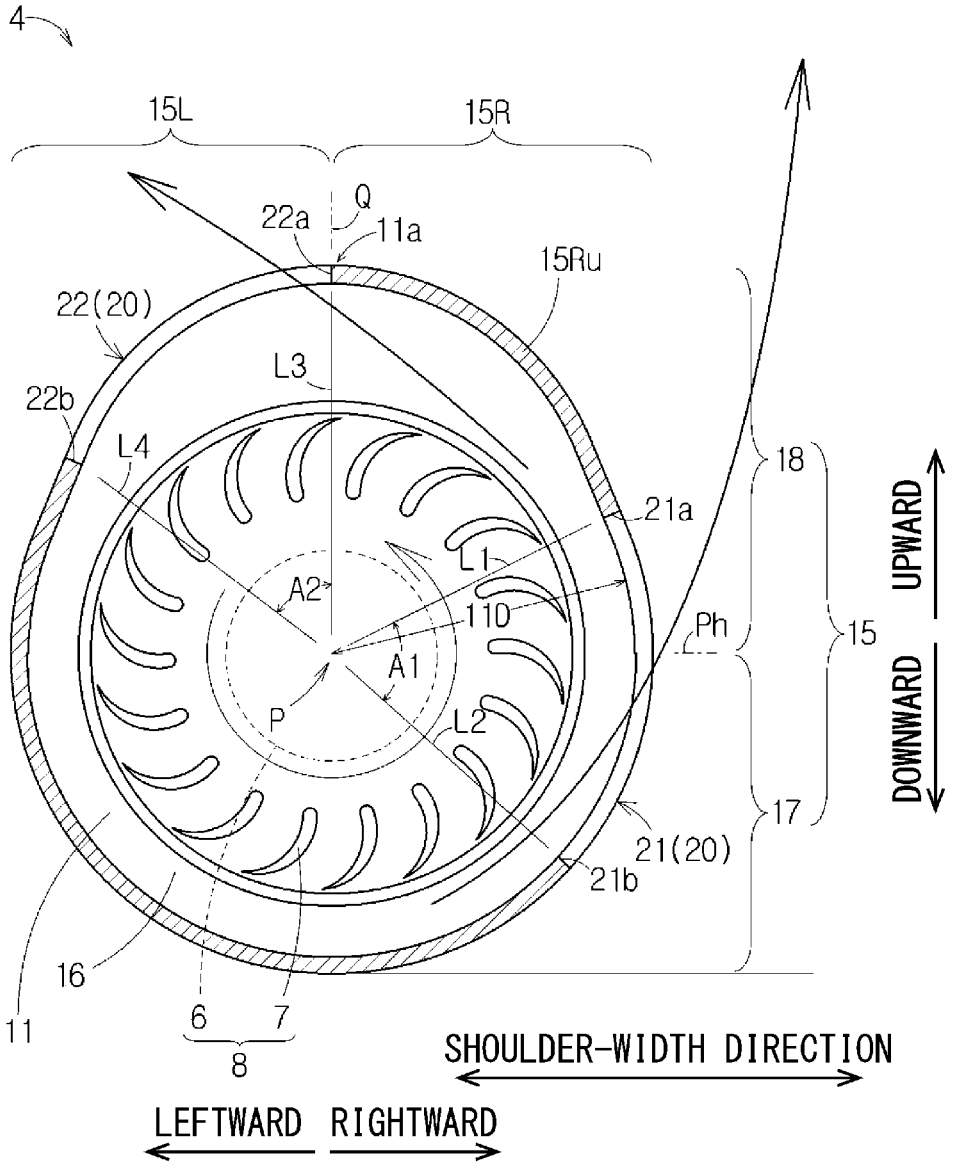
FIG. 4 is a rear view of a fan.

FIG. 4 shows a rear view of one of the fans 4. Note that illustration of the attaching nut 10 and sub-case 12 is omitted. Further, illustration of a safety grating of the air outlet of the fan 4 is also omitted. As shown in FIG. 4, the main case 11 includes a circumferential wall 15 opposed to the fan main body 8 in the radial direction, and a lid part 16 opposed to the fan main body 8 in the axial direction. The circumferential wall 15 includes a lower circumferential wall part 17 located below the rotation axis P of the motor 6, and an upper circumferential wall part 18 located above the rotation axis P of the motor 6.

The lower circumferential wall part 17 extends in an arc shape centered at the rotation axis P when the main case 11 is viewed along the rotation axis P. The lower circumferential wall part 17 extends in a semicircular shape centered at the rotation axis P as if protruding downward.

The upper circumferential wall part 18 has a shape formed in such a manner that the closer it becomes to the top part 11*a* of the main case 11, the more it is separated from the rotation axis P when the main case 11 is viewed along the rotation axis P. That is, a distance 11D from the rotation axis P to the upper circumferential wall part 18 increases as it becomes closer to the top part 11*a*.

Therefore, the circumferential wall 15 of the main case 11 is formed so that it has roughly an egg-like shape when the main case 11 is viewed along the rotation axis P. Further, each of the fans 4 is attached to the back part 3 of the garment main part 2 so that the sharply protruding part of the egg shape thereof points upward.

As shown in FIG. 4, two air outlets 20 are formed in the circumferential wall 15. The two air outlets 20 are a side air outlet 21 and an upper air outlet 22, respectively.

The side air outlet 21 is an example of the first air outlet. The side air outlet 21 is formed, in a right-side circumferential wall part 15R of the circumferential wall 15 located on the right side of a vertical reference plane Q, which is a vertical plane including the rotation axis P, at a position opposed to the rotation axis P in the shoulder-width direction. An angle A1 between a line segment L1 connecting the upper end 21*a* of the side air outlet 21 with the rotation axis P, and a line segment L2 connecting the lower end 21*b* of the side air outlet 21 with the rotation axis P is in a range of 70 to 90 degrees. Further, the angle A1 is preferably in a range of 75 to 85 degrees, and is 81 degrees in this embodiment. The side air outlet 21 is formed so that an angle between a horizontal reference line Ph, which is a line extending from the rotation axis P in a rightward direction parallel to the shoulder-width direction, and the line segment L1 becomes roughly equal to an angle between the horizontal reference line Ph and the line segment L2.

The upper air outlet 22 is an example of the second air outlet. The upper air outlet 22 is formed at a position located above the rotation axis P in a left-side circumferential wall part 15L located on the left side of the vertical reference plane Q. The angle A2 between a line segment L3 connecting the upper end 22*a* of the upper air outlet 22 with the rotation axis P, and a line segment L4 connecting the lower end 22*b* of the upper air outlet 22 with the rotation axis P is in a range of 70 to 90 degrees. The angle A2 is preferably in a range of 75 to 85 degrees, and is 81 degrees in this embodiment. The upper end 22*a* of the upper air outlet 22 coincides with the top part 11*a* of the main case 11.

The right-side circumferential wall part 15R includes a right-side upper part 15Ru as a part thereof located above the side air outlet 21.

Further, the fan main body 8 rotates so that each of the blades 7 constituting the fan main body 8 is successively opposed, in the radial direction, to the side air outlet 21, the right-side upper part 15Ru, and the upper air outlet 22 in this order. That is, in FIG. 4, the fan main body 8 rotates in a counterclockwise direction.

Therefore, the direction in which air is blown from the side air outlet 21 roughly coincides with the tangential direction of the circumferential wall 15 at the lower end 21*b* of the side air outlet 21, and is a rightward-inclined upward direction. Meanwhile, the direction in which air is blown from the upper air outlet 22 roughly coincides with the direction in which the right-side upper part 15Ru extends, and is a leftward-inclined upward direction. Therefore, the two air outlets 20 are formed in such a manner that their blowing directions have an upwardly-opened V-shape. Further, the two air outlets 20 are formed so that their blowing directions are restricted to obliquely upward.

Since the blowing directions are restricted to obliquely upward as described above, it is possible to secure a sufficient wind velocity up to the shoulders of the wearer. Note that even when the blowing directions are restricted to upward, it is possible to secure a sufficient wind velocity up to the shoulders of the wearer as in the case of the above-described blowing directions.

Further, since the two air outlets 20 are formed in such a manner that their blowing directions have the upwardly-opened V-shape, it is possible to secure a sufficient wind velocity over a wide range in the shoulder-width direction.

Further, since the two fans 4 are arranged side by side in the shoulder-width direction as shown in FIG. 1, it is possible to secure a sufficient wind velocity in a wider range in the shoulder-width direction. Further, since the blowing directions are restricted to being upward or obliquely upward, the winds blown from the two fans 4 do not cancel each other out.

Figure 5:
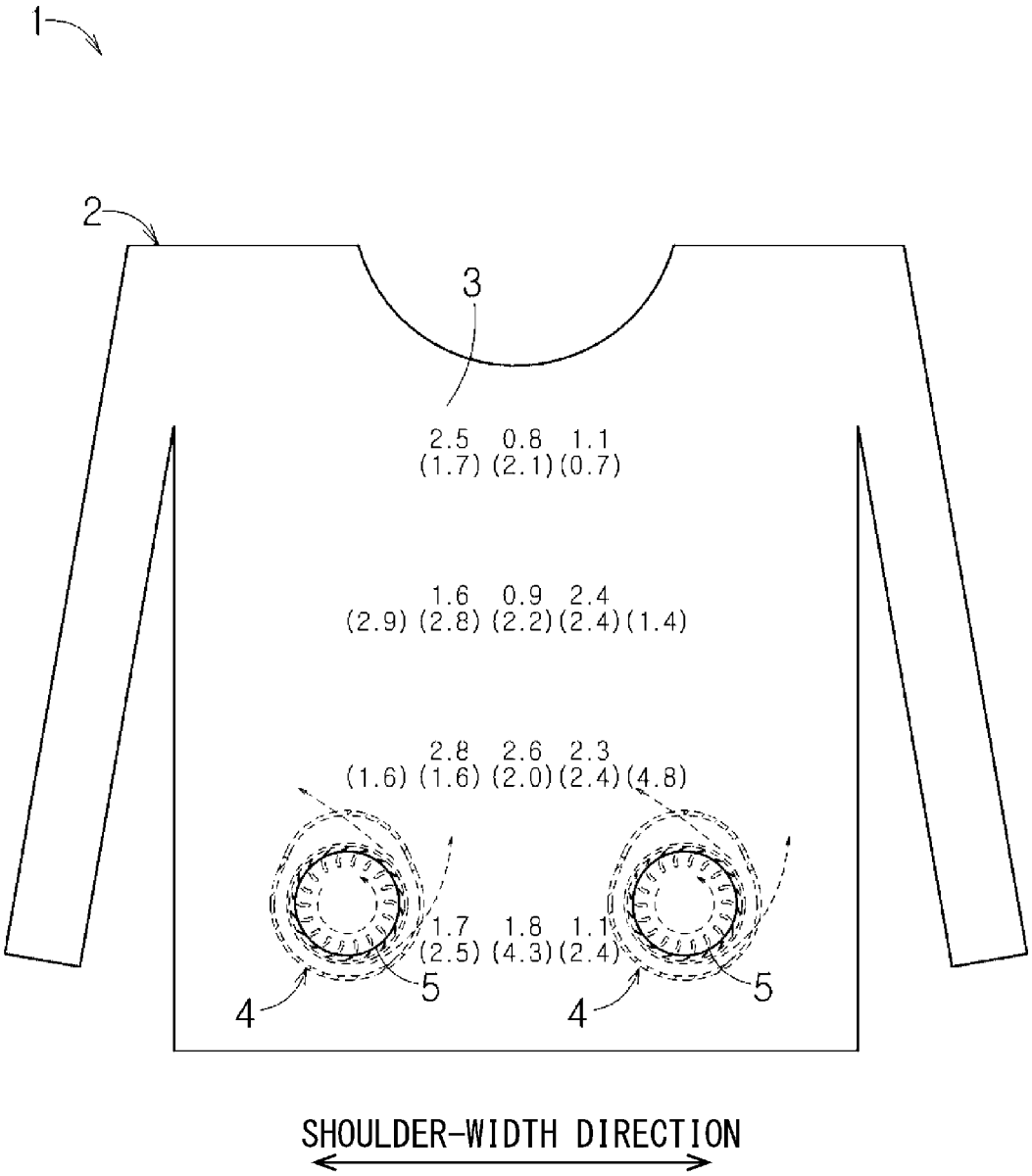
FIG. 5 shows results of wind-velocity measurement.
Figure 6:
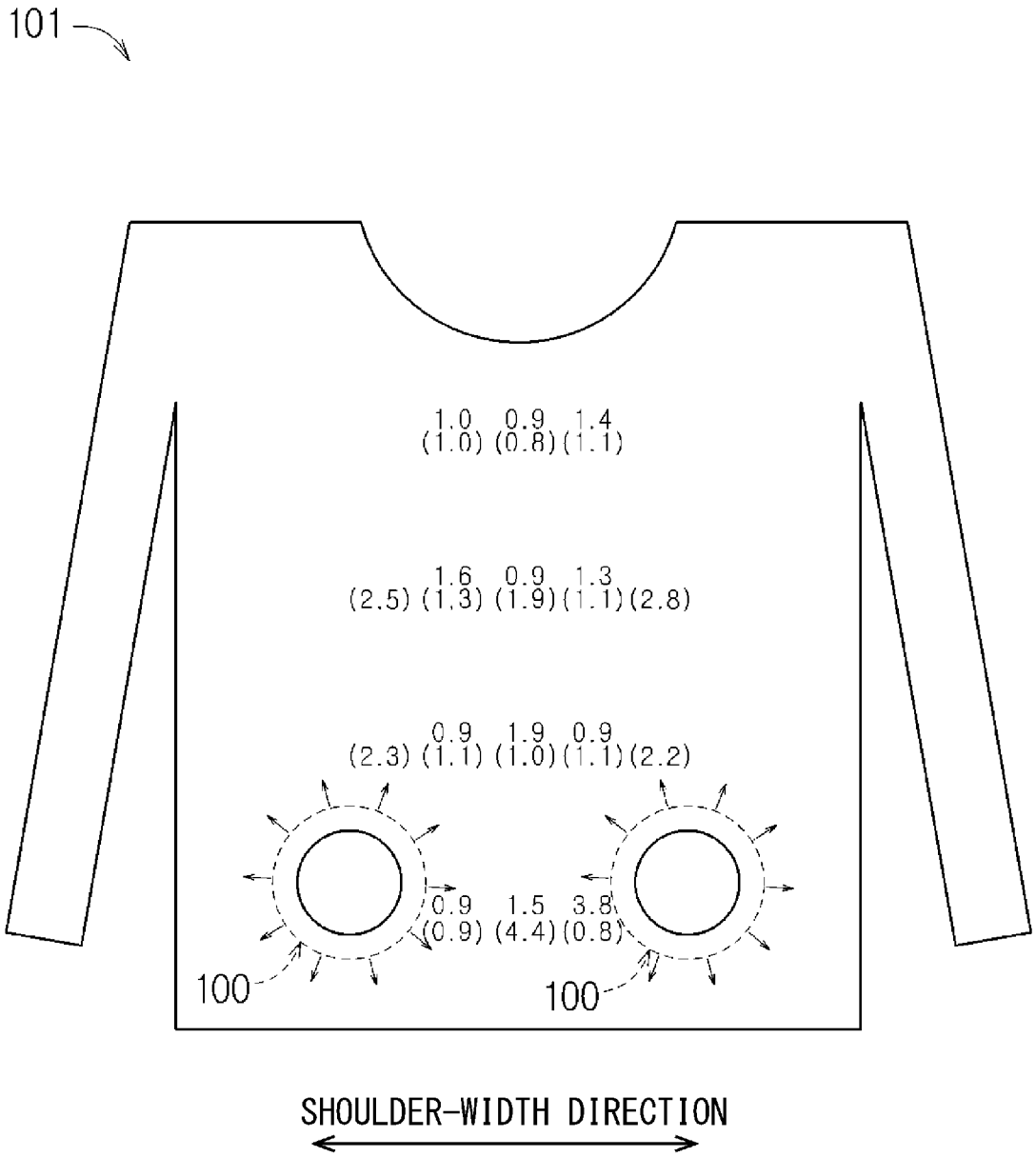
FIG. 6 shows results of wind-velocity measurement of a comparative example.

FIGS. 5 and 6 show results of experiments of wind-velocity measurement. FIG. 5 corresponds to the embodiment according to the present disclosure. FIG. 6 shows an air-conditioning garment 101 equipped with two fans 100, and the direction in which air is blown from each of the fans 100 is not restricted at all. That is, each of the fans 100 is configured to blow air over the entire circumference, i.e., over 360 degrees. The motor of each of the fans 100 is the same as that of the motor 6 in the embodiment according to the present disclosure, and the output of each of all the motors is 5 W. Numerical values shown in each of the drawings indicate wind velocities measured by nondirectional anemometers, and are expressed in the unit of m/s. Numerical values in parentheses indicate results of measurement by an anemometer placed between the front part and the upper body, and numerical values without parentheses indicate results of measurement by an anemometer placed between the back part and the upper body. The results of the measurement are shown at positions where the anemometer was actually placed. By comparing between FIGS. 5 and 6, it can be understood that sufficient wind velocities were able to be secured up to the shoulders of the wearer by restricting the blowing directions to upward or obliquely upward as described in the embodiment according to the present disclosure. Further, it has been demonstrated that since the blowing directions were restricted to being upward or obliquely upward, winds blown from the two fans 4 did not cancel each other out.

A preferred embodiment according to the present disclosure has been described above, and the above-described embodiment has the following features.

As shown in FIGS. 1 to 4, the air-conditioning garment 1 includes a garment main part 2 that is worn on the upper body of a wearer, and two fans 4 that are attached to the lower part of the back part 3 of the garment main part 2, and configured to feed outside air into the inside of the garment main part 2. Each of the two fans 4 includes a fan main body 8, and a case 9 that houses the fan main body 8 and includes two air outlets 20. The two air outlets 20 are formed so that their blowing directions are restricted to being upward or obliquely upward. According to the above-described configuration, it is possible to secure a sufficient wind velocity up to the shoulders of the wearer.

Note that although the air-conditioning garment 1 includes two fans 4 in the above-described embodiment, the air-conditioning garment 1 may include only one fan 4. Further, although each of the fans 4 includes two air outlets 20 in the embodiment, each of the fans 4 may include only one air outlet 20.

Further, as shown in FIG. 4, the two air outlets 20 are formed in such a manner that their blowing directions have an upwardly-opened V-shape. According to the above-described configuration, it is possible to secure a sufficient wind velocity over a wide range in the shoulder-width direction.

Further, as shown in FIG. 4, each of the fans 4 is a centrifugal fan. The case 9 includes a circumferential wall 15 opposed to the fan main body 8 in the radial direction. The lower circumferential wall part 17, which is a part of the circumferential wall 15 located below the rotation axis P of the fan main body 8, extends in an arc shape centered at the rotation axis P. The upper circumferential wall part 18, which is a part of the circumferential wall 15 located above the rotation axis P of the fan main body 8, has a shape formed in such a manner that the closer it becomes to the top part 11*a* of the case 9, the more it is separated from the rotation axis P. The two air outlets 20 are a side air outlet 21 (a first air outlet) and an upper air outlet 22 (a second air outlet), respectively. The side air outlet 21 is formed, in the right-side circumferential wall part 15R (a first circumferential wall part) of the circumferential wall 15 located on the right side (one side) of the vertical reference plane Q, which is a vertical plane including the rotation axis P, at a position opposed to the rotation axis P in the shoulder-width direction. The upper air outlet 22 is formed, in the left-side circumferential wall part 15L (a second circumferential wall part) of the circumferential wall 15 located on the left side (the other side) of the vertical reference plane Q, which is the vertical plane including the rotation axis P, at a position located above the rotation axis P. The fan main body 8 rotates so that the blades 7 of the fan main body 8 are successively opposed to the side air outlet 21, the right-side upper part 15Ru, which is the part of the right-side circumferential wall part 15R located above the rotation axis P, and the upper air outlet 22 in this order. According to the above-described configuration, blowing directions having an upwardly-opened V-shape are realized.

Further, as shown in FIG. 1, the two fans 4 are arranged side by side in the shoulder-width direction. According to the above-described configuration, it is possible to secure a sufficient wind velocity in a wider range in the shoulder-width direction. Further, since the blowing directions are restricted to being upward or obliquely upward, winds blown from the two fans 4 do not cancel each other out.

Further, the above-described embodiment can be modified as described below.

That is, as shown in FIG. 1, the two fans 4 have shapes and structures exactly identical to each other, and are attached to the back part 3 of the garment main part 2 in the same direction as each other. Therefore, the two fans 4 are not linearly symmetrical to each other with respect to the center line vertically extending in the back part 3 of the garment main part 2. However, the two fans 4 may instead have shapes that are linearly symmetrical to each other with respect to the center line vertically extending in the back part 3 of the garment main part 2.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. An air-conditioning garment comprising:

a garment main part adapted to be worn on an upper body of a wearer; and at least one fan attached to a lower part of a back part of the garment main part, the at least one fan being configured to feed outside air into inside of the garment main part, wherein the at least one fan includes a fan main body, and a case including at least one air outlet, the case being configured to house the fan main body, wherein the at least one air outlet is configured to blow air in a blowing direction that is restricted to being upward and/or obliquely upward wherein the at least one air outlet includes two air outlets, wherein the two air outlets being configured to blow air in the blowing direction includes being configured to blow air in an upwardly-opened V-shape, wherein the at least one fan is a centrifugal fan;

wherein the case comprises a circumferential wall that is opposed to the fan main body in a radial direction;

wherein a lower part of the circumferential wall that is located below a rotation axis of the fan main body extends in an arc shape that is centered with respect to the rotation axis;

wherein an upper part of the circumferential wall that is located above the rotation axis of the fan main body has a shape such that portions of the upper part of the circumferential wall that are closer to a top part of the case are more separated from the rotation axis;

wherein the two air outlets are a first air outlet and a second air outlet, respectively;

wherein the case defines a vertical plane that passes through the rotation axis of the fan main body and divides the case into a left side and a right side in a shoulder-width direction, the shoulder-width direction corresponding to a line between shoulder portions of the garment main part;

wherein the first air outlet is disposed in the circumferential wall on one of the right side or the left side, the first air outlet being at a position opposed to the rotation axis in the shoulder-width direction;

wherein the second air outlet is disposed in the circumferential wall on an other of the right side or the left side at a position located above the rotation axis;

wherein the fan main body is configured to rotate so that a blade of the fan main body is successively opposed to the first air outlet, the upper part of the circumferential wall on the one of the right side or the left side, and the second air outlet in this order wherein the first outlet is defined between a first circumferential wall interface and a second circumferential wall interface, a line between the rotation axis and the first circumferential wall interface and a line between the rotation axis and the second circumferential wall interface defining a first angle;

wherein the second outlet is defined between a third circumferential wall interface and a fourth circumferential wall interface, a line between the rotation axis and the third circumferential wall interface and a line between the rotation axis and the fourth circumferential wall interface defining a second angle;

wherein each of the first angle and the second angle is between 70° and 90°.

2. The air-conditioning garment according to claim 1, wherein each of the first angle and the second angle is between 75° and 85°.

3. The air-conditioning garment according to claim 1, wherein the case comprises an egg shaped circumferential wall that is opposed to the fan main body in a radial direction; and wherein a pointed end of the egg shaped circumferential wall points toward an upper part of the back part of the garment main part.

* * * * *